United States Patent [19]

Hayward et al.

[11] 3,970,003

[45] July 20, 1976

[54] PYROPHORIC FLARE

[75] Inventors: Frederick R. Hayward, Westford; L. James Larson, Boxford, both of Mass.

[73] Assignee: Avco Corporation, Cincinnati, Ohio

[22] Filed: Oct. 16, 1974

[21] Appl. No.: 515,182

[52] U.S. Cl. ..... 102/37.8; 102/60; 102/87

[51] Int. Cl.[2] ..... F42B 4/26

[58] Field of Search ..... 102/6, 37.8, 65, 66, 102/90, 87, 60

[56] References Cited

UNITED STATES PATENTS

| | | | |
|---|---|---|---|
| 1,376,316 | 4/1921 | Chilowsky | 102/66 |
| 2,958,277 | 11/1960 | Snelling | 102/90 |
| 3,433,437 | 3/1969 | Bates | 102/66 |
| 3,683,815 | 8/1972 | Shaffer | 102/65 |

*Primary Examiner*—Verlin R. Pendegrass
*Attorney, Agent, or Firm*—Charles M. Hogan; Abraham Ogman

[57] ABSTRACT

The invention is directed to a pyrophoric flare comprising a normally closed container containing a pyrophoric substance. A perforated cylinder may be immersed in the pyrophoric substance to meter the flow of the pyrophoric substance into the atmosphere. The container is configured to completely or partially fragment when activated to release the pyrophoric substance into the atmosphere.

5 Claims, 4 Drawing Figures

Fig. 1.
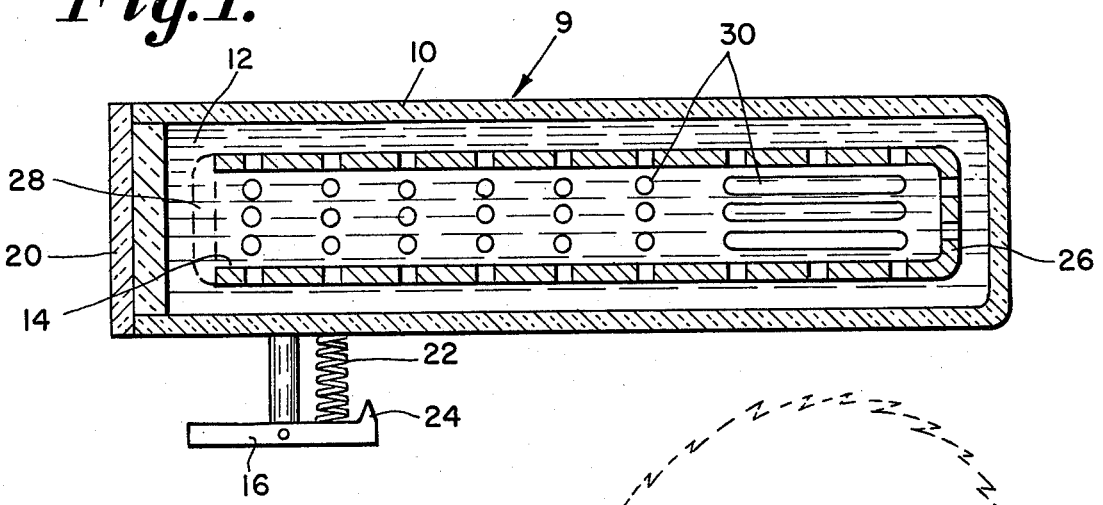
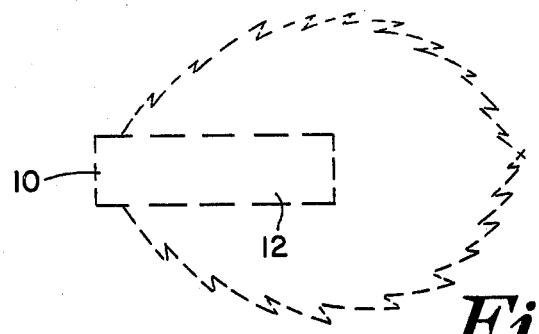
Fig. 2.
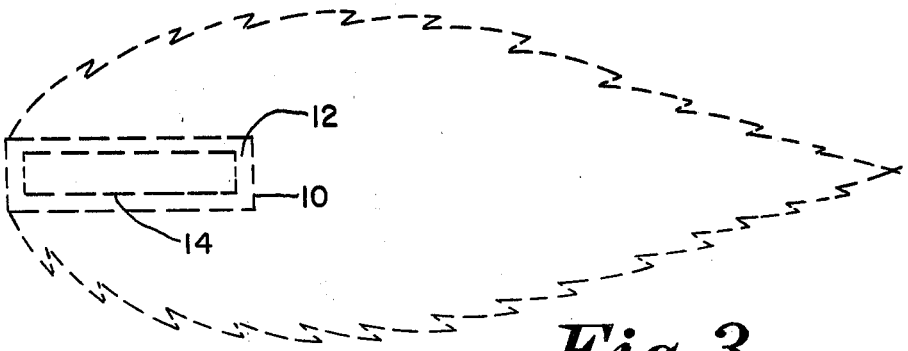
Fig. 3.
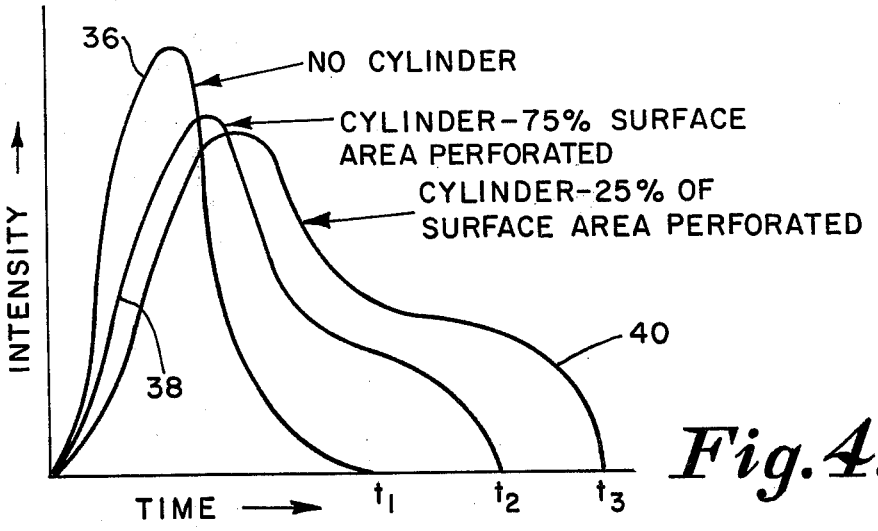
Fig. 4.

PYROPHORIC FLARE

Pyrophoric flares are known in the art. In general, a pyrophoric substance is contained within a container. When the container is opened and the pyrophoric substance comes in contact with the atmosphere, it spontaneously bursts into flames, creating a flare.

Means for metering the flow of the pyrophoric substance into the atmosphere are also known and used for extending the duration of the flare.

DEFINITIONS

For purposes of this invention, a frangible container is defined as a container which, upon the application of an external stimulus, fragments into small particles substantially instantaneously.

Also within the context of this invention, instantaneously is defined to mean a relatively short time duration when compared to the duration of the resulting flare.

DISCUSSION

In accordance with the invention, the pyrophoric flare comprises a container, preferably a frangible container, containing a pyrophoric substance. In another modification, the invention comprises a container filled with a pyrophoric substance and also having positioned within the container and within the pyrophoric substance a hollow perforated member such as a perforated cylinder. The perforated member acts as a metering means for extending the duration, or burn time, of the flare.

It is also contemplated that the flare may contain means for increasing the viscosity of the pyrophoric substance so that normally incompatible additives for modifying the physical characteristics of the flare may be uniformly distributed within the pyrophoric substance.

It is an object of the invention to provide a pyrophoric flare which avoids the limitations and disadvantages of prior devices of this type.

It is another object of the invention to provide a pyrophoric flare within a container capable of exposing the pyrophoric substance to the atmosphere substantially instantaneously.

It is yet another object of the invention to provide a pyrophoric flare which includes a perforated hollow member as a metering means.

It is still another object of the invention to provide a method of modifying a pyrophoric substance so that it may accept additives which are normally not suspendible or miscible within the pyrophoric substance.

The novel features that are considered characteristic of the invention are set forth in the appended claims; the invention itself, however, both as to its organization and method of operation, together with additional objects and advantages thereof, will best be understood from the following description of a specific embodiment when read in conjuction with the accompanying drawings, in which:

FIG. 1 is a schematic representation of a pyrophoric flare, including metering means, as embodied in the subject invention;

FIG. 2 is a schematic representation of a burning flare without metering means;

FIG. 3 is a schematic representation of a burning flare with metering means; and FIG. 4 depicts a series of curves which show the effect of varying the percentage of openings in a perforated cylinder on the burn duration of a flare.

Referring to FIG. 1 of the drawings, there is shown a pyrophoric flare 9 having a container 10 filled with a pyrophoric substance 12. Immersed within the pyrophoric substance is a metering means 14. Attached to the container 10 is a springloaded bore rider 16.

The container 10 is frangible. The preferred material is a chemically strengthened glass, several forms of which are made by Corning and Owens-Illinois glass companies and are sold under trade names Chemcor and Cer-vit, respectively. While this type of glass has an extremely high strength so long as its physical integrity remains intact, when the surface of the glass is pierced by a sharp object, such as a point, the glass fragments into small particles, substantially instantaneously. The size of the fragements is determined by the glass manufacturing process. Typically, fragments having a diameter equal to the wall thickness of the container are used. Upon fragmenting, the entire contents of the container are exposed to the atmosphere, also substantially instantaneously.

The frangible glass container 10 is closed at one end 18 and is capped and closed by a plastic cover 20 at the other end. Clearly, in the alternative, both ends may be capped.

The flare 9 disclosed in FIG. 1 is adapted to be stored in a cylindrical bore and the flare is activated by ejecting the container out of the nozzle into the atmosphere. While the flare is within the bore, the bore rider 16 is in the horizontal position, shown in FIG. 1. When the constraint of the bore is removed, a spring 22 causes the point 24 to pivot and impact the container 10. Upon impact, the container fragments.

The container 10 is filled with pyrophoric substance 12. Pyrophoric substances are manufactured and marketed by a variety of companies. The invention does not depend on the type of pyrophoric substance used, although a fluid, gel or powder is preferred. By way of example, one, or a combination of the following pyrophoric substances are suggested: triethylaluminum, triisobutylaluminum, diethylaluminum chloride, diisobutylaluminum chloride, diethylaluminum iodide, and diisobutylaluminum hydride. These are manufactured for commercial use by Texas Alkyls, Inc.

A metering means 14 for containing a portion of the pyrophoric substance, and for releasing it into the atmosphere more gradually than the fragmented container, is provided. The form of the metering means 14, shown in FIG. 1, is a hollow cylinder with perforations uniformly dispersed over the surface of the cylinder. The ends 26 and 28 of the cylinder may or may not be closed, respectively. The perforations 30 may be circular holes or slots or other shapes.

Alternatively, the metering means may comprise an open cellular material, such as steel wool, open celled foam, etc. The pyrophoric substance impregnants the cellular structure and is released to the atmosphere over a period of time.

In one application, the pyrophoric flare 9 is carried in a bore under the wing of an aircraft. It is ejected at a velocity of several hundred feet per second.

When the container 10 is fragmented, the pyrophoric substances outside of the cylinder 14 come into contact with the atmosphere immediately and creates a flare. The pyrophoric substances within the cylinder 14 escape from the cylinder 14 through the perforations 30 and are ignited sequentially. The rate at which the pyrophoric substances escape through the perforations determines the ultimate length of the flare.

FIG. 2 shows a pyrophoric flare without metering means. The fireball 32 is generally spherical in shape, although some longitudinal elongation is present.

FIG. 3 shows the flare with a metering means 14. The fireball 34 is generally longer than it is wide. This is a direct result of the gradual leakage of pyrophoric substances from the cylinder through the perforations into the atmosphere.

Referring to FIG. 4, the phenomena just described is shown graphically, Curve 36 shows a relatively high intensity, but short duration, flare and corresponding to a flare without metering means. Curve 38 shows a flare with a tube in which the perforations comprise 75% of the surface area of the tube. The resulting flare has a lower intensity than that shown in Curve 36; but, on the other hand, its duration is somewhat longer. Curve 40 is indicative of a tube having perforations forming 25% of the surface area of the tube. A still longer duration flare results, again with some loss in the peak intensity.

In most cases, the pyrophoric substances are liquids. In many cases, it is desirable to add to the pyrophoric substance an additive which changes the characteristics of the intensity and/or spectral response of the resulting flare. For example, when carbon particles are added to the flare, the particles are heated and, in turn, emit radiation in a specific wave length thereby changing the spectral response from that given off by the basic pyrophoric substance. If combustible materials are added to the pyrophoric substance, they will burn exothermically and add energy and intensity to the flare.

Most pyrophoric substances are liquids In most cases, it is not possible to uniformly distribute an additive throughout the pyrophoric substance because the additive is immiscible or cannot be permanently suspended in the pyrophoric substance.

To avoid this limitation, an additive such as colloidal silica (Colosil) is added to convert the pyrophoric substance into a gel which, because of its increased viscosity, will allow additives to be uniformly dispersed therein.

The various features and advantages of the invention are thought to be clear form the foregoing description. Various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

We claim:

1. A pyrophoric flare comprising:

a. a frangible container;

b. a pyrophoric substance contained in said container;

c. means for fragmenting the container for releasing the pyrophoric substance to the atmosphere; and d. measuring means for containing a portion of said pyrophoric substance and for gradually releasing measured amounts of said pyrophoric substance into the atmosphere to extend the duration of the flare.

2. A pyrophoric flare as described in claim 1 wherein the perforated container is a cylinder.

3. A pyrophoric flare as described in claim 1 wherein said container is frangible into fragments substantially instantaneously.

4. A pyrophoric flare as described in claim 3 which includes in addition a perforated container immersed in the pyrophoric substance;

means for increasing the viscosity of the pyrophoric substance to enable said pyrophoric substance to accept additives in suspension; and a normally immiscible or non-suspendible additive distributed throughout the pyrophoric substance for modifying the characteristics of the resulting flare.

5. A pyrophoric flare as defined in claim 4 which includes in addition means for converting the pyrophoric substance to a gel and additives for modifying the characteristics of the resulting flare distributed throughout the pyrophoric substance.

* * * * *